US006155010A

United States Patent [19]

Becken et al.

[11] Patent Number: 6,155,010

[45] Date of Patent: Dec. 5, 2000

[54] WINDOW GRILL CLIPS

[75] Inventors: Donald A. Becken, Burbank; Petros Z. Mantarakis, Northridge, both of Calif.

[73] Assignee: Reflectolite Products, Inc., Pacoima, Calif.

[21] Appl. No.: 09/159,567

[22] Filed: Sep. 24, 1998

[51] Int. Cl.[7] ..... E06B 3/964

[52] U.S. Cl. ..... 52/204.61; 24/570; 49/57; 49/62; 52/456; 52/507; 52/712; 52/745.19

[58] Field of Search ..... 24/570; 49/57, 49/62; 52/204.53, 204.61, 204.62, 204.64, 204.69, 456, 507, 712, 745.19, 773, 774

[56] References Cited

U.S. PATENT DOCUMENTS

| | | | |
|---|---|---|---|
| 790,908 | 5/1905 | Mills . | |
| 1,073,805 | 9/1913 | Kinnear . | |
| 1,946,716 | 2/1934 | Smidt . | |
| 2,617,159 | 11/1952 | Leighton | 52/774 X |
| 2,714,432 | 8/1955 | Blanchard . | |
| 2,813,313 | 11/1957 | Shrode | 52/773 |
| 2,901,786 | 9/1959 | Batts . | |
| 3,208,119 | 9/1965 | Seckerson | 52/712 X |
| 3,372,522 | 3/1968 | Engstrom | 52/456 |
| 3,694,984 | 10/1972 | Schwartz | 52/773 X |
| 4,272,938 | 6/1981 | Seipos | 52/774 X |
| 4,586,306 | 5/1986 | Webb | 52/204.61 |
| 4,644,721 | 2/1987 | Bloomquiste et al. | 52/456 |
| 4,793,106 | 12/1988 | Jonsson | 52/204.53 |
| 4,854,100 | 8/1989 | La See . | |
| 5,109,647 | 5/1992 | La See . | |
| 5,634,314 | 6/1997 | Champagne | 52/712 |

*Primary Examiner*—Carl D. Friedman
*Assistant Examiner*—Kevin D. Wilkens
*Attorney, Agent, or Firm*—Hill & Simpson

[57] ABSTRACT

Window grill clips which can be used to removably attach window grills to windows. The window grill clip has a window frame segment and a grill segment extending from the window frame segment at an upward inclined angle. An opening is defined through the grill segment. A tang connected to the grill segment has a first leg extending away from the grill segment and a second leg extending from the first leg and back toward the opening in the grill segment. The grill segment may have a tab which extends downward from and end of the grill segment opposite an end of the grill segment connected to the window frame segment. Window frame engagement spikes may be provided on the window frame segment.

17 Claims, 3 Drawing Sheets

WINDOW GRILL CLIPS

FIELD OF THE INVENTION

The present invention generally relates to window grill clips which can be used to attach window grills to windows.

BACKGROUND OF THE INVENTION

Windows have been provided with window grills that are mounted to the windows next to the window panes. The window grills provide a desired appearance to the windows, and may be removably mounted to the windows. Various devices have been used to attach the window grills to the windows. However, it would be advantageous to have new window grill clips.

An example of a grill clip is shown and described in U.S. Pat. No. 5,109,647, and a concealed snap-in grill clip is shown and described in U.S. Pat. No. 4,854,100.

SUMMARY OF THE INVENTION

The present invention provides new window grill clips which can be used to attach window grills to windows. The window grill clips can be used to mount many types of window grills to various types of windows, including, for example windows in walls and windows in doors. The window grill clips may removably attach the grills to the windows. Also, the window grill clips can be concealed by the window frame and the grill to provide a desired appearance of the window.

One window grill clip according to the present invention has a window frame segment and a grill segment extending from the window frame segment at an upward inclined angle. An opening is defined through the grill segment. A tang connected to the grill segment has a first leg extending upward and away from the grill segment and a second leg extending from the first leg downward and back toward the opening in the grill segment. The grill segment may have a tab which extends downward from and end of the grill segment opposite an end of the grill segment connected to the window frame segment. Engagement spikes may be provided on the window frame segment.

The present invention also provides new methods for making window grill clips. One new method of making window grill clips according to the present invention includes forming a window frame segment, forming a grill segment extending from the window frame segment, defining an opening through the grill segment, and forming a tang having a first portion extending away from the grill segment and a second portion extending from the first portion and back toward the opening in the grill segment. A portion of the grill segment may be formed into the tang and also define the opening through the grill segment. A grill tab may also be formed extending downward from an end of the grill segment opposite an end of the grill segment connected to the frame segment.

One advantage of the present invention is to provide new window grill clips. Another advantage of the present invention is to provide new methods to make window grill clips.

The new window grill clips of the present invention provide convenient and cost effective ways of making grill clips and mounting window grills to windows.

Another advantage of the present invention is to removably mount window grills to windows.

Another advantage of the present invention is to provide window grill clips having a window frame segment, a grill segment extending from the window frame segment, the grill segment defining an opening through the grill segment, and a tang having a first portion extending away from the grill segment and a second portion extending from the first portion and back toward the opening in the grill segment.

These and other objects and advantages of the present invention will become apparent upon reading this disclosure, including the appendant claims with reference to the accompanying drawings. Although these and other objects and advantages may be desired, they may not be required to practice the present invention.

DETAILED DESCRIPTION OF PRESENTLY PREFERRED EMBODIMENTS

Although the present invention can be made in many different forms, the presently preferred embodiments are described in this disclosure and shown in the attached drawings. This disclosure exemplifies the principles of the present invention and does not limit the broad aspects of the invention to the illustrated embodiments.

A new window grill clip 10 according to the principles of the present invention is shown by way of example in FIGS. 1–4. The window grill clip 10 has a window frame segment 12 for attaching the window grill clip 10 to a window frame. The window frame segment 12 is substantially flat so that it can fit between a window frame and a window pane, such as a glass pane, held by the window frame. A pair of spikes 14 extend from the window frame segment 12 which anchor the window grill clip 10 to the window frame. The lower end of the window frame segment 12 is tapered to a point 15 to assist in sliding the window frame segment 12 between a window frame and a window pane.

Figure 3:
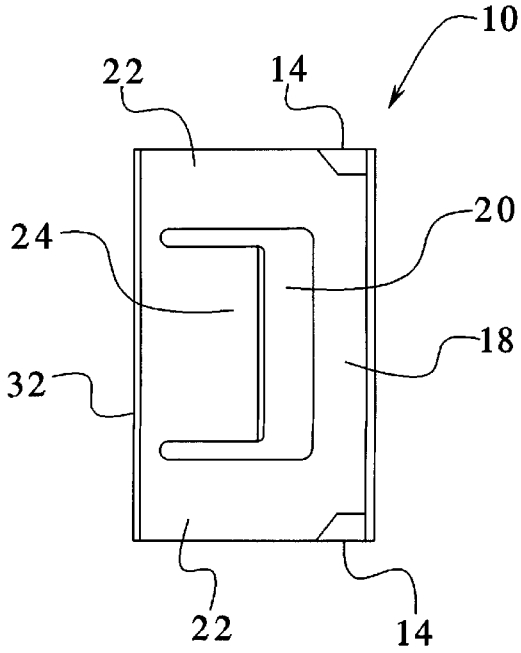
FIG. 3 is a bottom plan view of the window grill clip of FIG. 1.

The window grill clip 10 has a grill segment 16 extending from the window frame segment 12 at an upwardly inclined angle. The grill segment 16 engages the window grill to releasable mount the window grill to the window. Referring to FIG. 3, the grill segment 16 is generally Y-shaped in which a lower leg 18 of the Y-shape is connected to the upper end of the window frame segment 12. An opening 20 through the grill segment 16 is defined between two upper legs 22 of the Y-shaped grill segment 16. The end of the grill segment 16 opposite the window frame segment 12 extends across the width and connects the ends of the upper legs 22.

Figure 2:
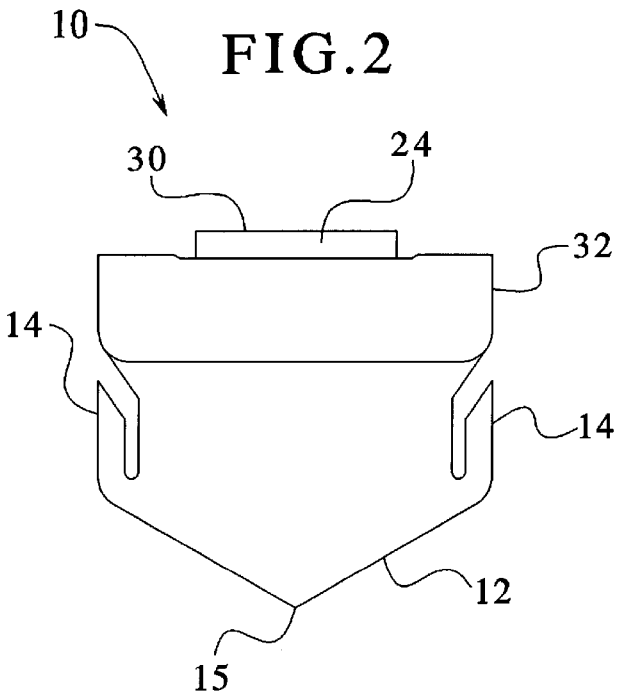
FIG. 2 is a front elevational view of the window grill clip of FIG. 1.
Figure 1:
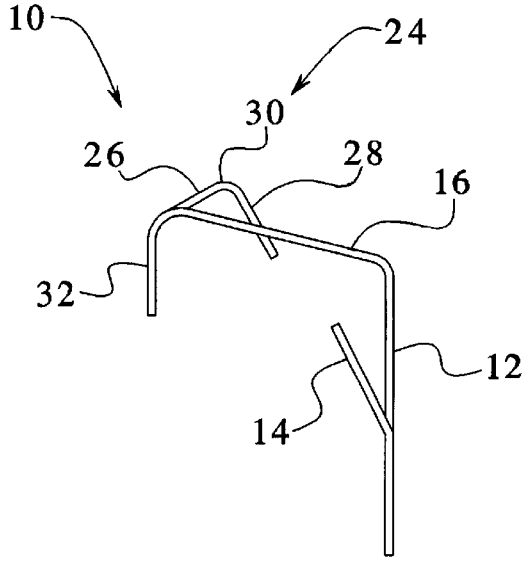
FIG. 1 is a side elevational view of a window grill clip according to the principles of the present invention.

Referring to FIGS. 1–4, a tang 24 is provided to engage the window grill and removably mount the grill to the window. The tang 24 has a first tang leg 26 extending upward and away from the grill segment 16 and a second tang leg 28 extending from the first tang leg 26 downward and back toward the opening 20 in the grill segment 16. A rounded grill engagement corner 30 is provided at the junction of the first and second tang legs 26, 28. As can be seen in FIG. 1, the second tang leg 28 may extend through the opening 20 in the grill segment 16.

A tab 32 may be provided at the end of the grill segment 16 opposite from the end of the grill segment 16 connected to the window frame segment 12. The tab 32 forms a rounded corner with its connection to the grill segment 16 and extends downwardly, as viewed in FIG. 1. The tab 32 abuts the window grill when the grill is mounted to the window by the window grill clip 10.

Figure 5:
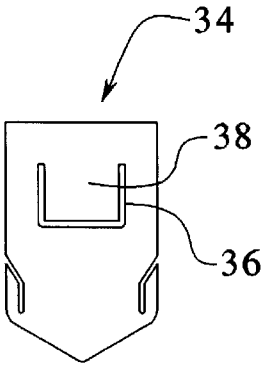
FIG. 5 is a plan view of a flat blank used to make the window grill clip of FIG. 1.

Referring to FIG. 5, a flat blank 34 which can be used to make the window grill clip 10 is shown. The flat blank 34 can be stamped from a desired material, such as metal, and then formed into the grill clip 10. A U-shaped opening 36 is formed in the flat blank 34 and forms a tang blank 38. The flat blank 34 is bent to form the window frame segment 12 and the grill segment 16 extending from the window frame segment 12. The tang blank 38 is bent to form the tang 24, including the first and second tang legs 26, 28. The tab 32 is formed by bending an end of the flat blank opposite the pointed end 15, and the spikes 14 are formed by bending the spike portions of the flat blank 34 at an angle.

Figure 6:
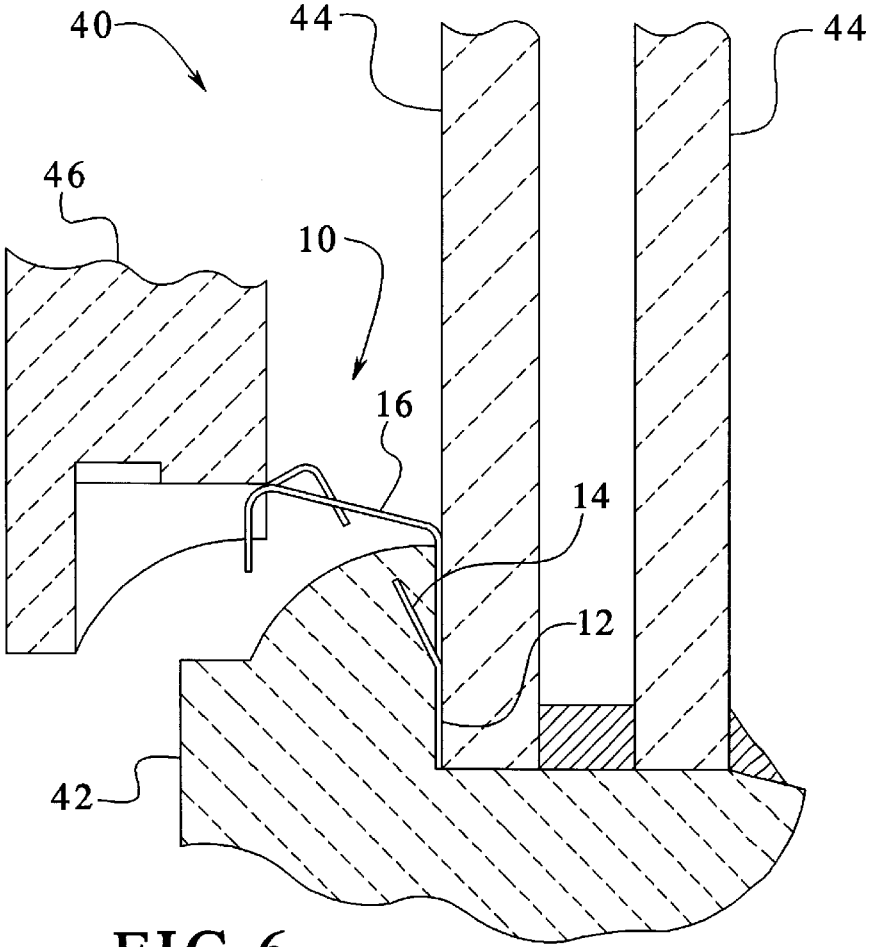
FIG. 6 is a side view of the window grill clip of FIG. 1 with a window grill ready to be installed on a window.
Figure 4:
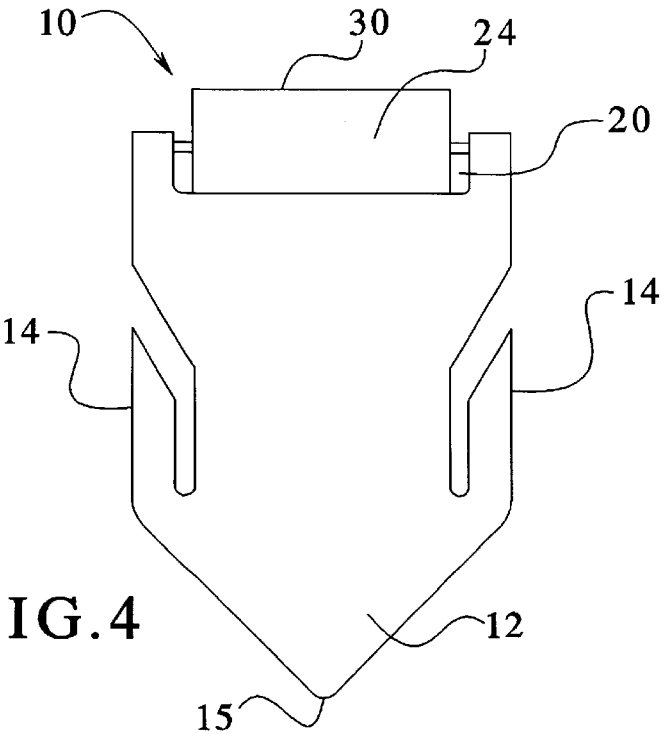
FIG. 4 is a rear elevational view of the window grill clip of FIG. 1.

Operation of the window grill clip 10 will be explained further with reference to FIGS. 6–8. In FIG. 6, the window grill clip 10 has been installed on a window 40. The window frame segment 12 is positioned between a window frame 42 and a window pane 44, with the spikes 14 engaging the window frame 42. A window grill 46 is ready to be installed on the window 40 by the window grill clip 10.

Figure 7:
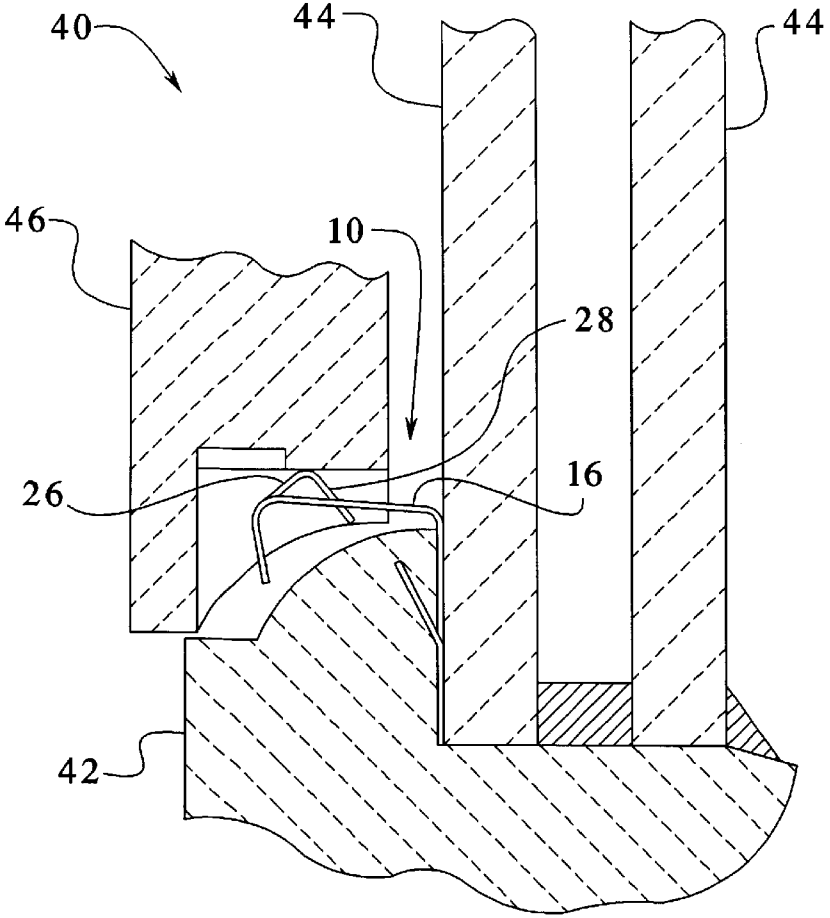
FIG. 7 is a side view of the window grill clip of FIG. 1 with the window grill partially installed on the window.

FIG. 7 shows the window grill 46 partially installed on the window 40. The grill segment 16 of the window grill clip 10 is resiliently bent downward as the window grill 46 pushes on the first tang leg 26 of the tang 24. The first tang leg 26 is angled upward which forces the grill segment 16 downward when the window grill 46 is mounted on the window grill clip 10. The window grill 46 has a recess 48 for receiving and concealing the window grill clip 10, particularly the grill segment 16.

Figure 8:
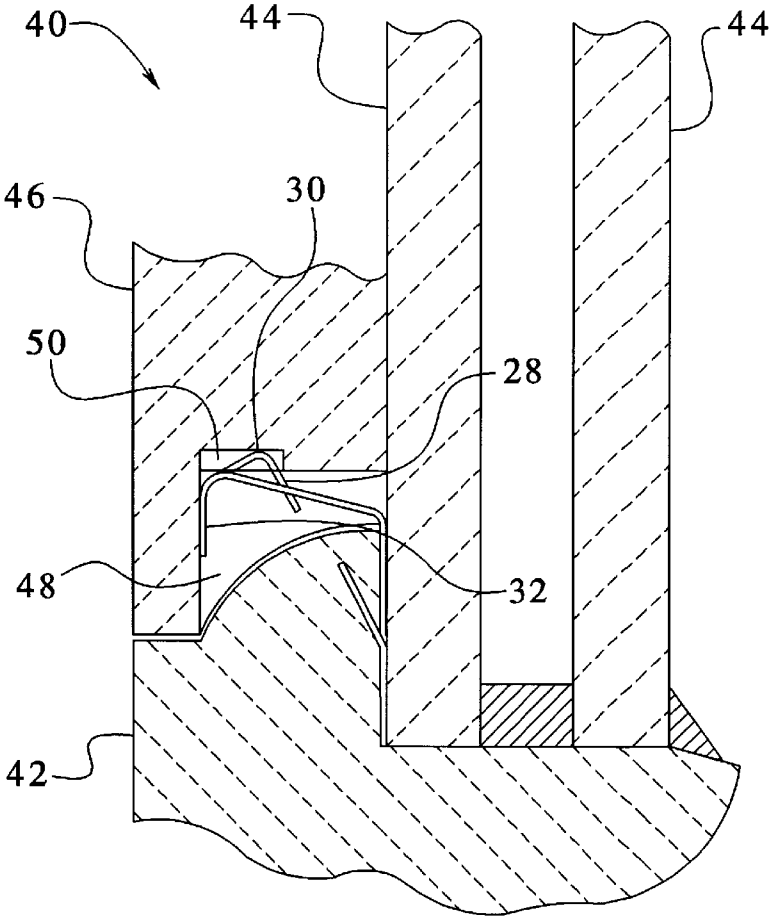
FIG. 8 is a side view of the window grill clip of FIG. 1 with the window grill installed on the window.

The window grill 46 is shown installed on the window 40 by the window grill clip 10 in FIG. 8. The tang 24, specifically the rounded engagement corner 30, engages the window grill 46 by flexing upward into a notch 50 adjacent the recess 48 in the end of the window grill 46. The tab 32 on the window grill clip 10 abuts the window grill 46 at an inside surface defined by the recess 48.

The window grill 46 can be easily removed from the window 40. The window grill 46 is pulled away from the window 40 and the slanted second tang leg 28 of the tang 24 causes the grill segment 16 to resiliently flex downward. As the grill segment 16 flexes downward, the tang 24 releases the window grill 46 to achieve the position shown in FIG. 7, particularly the engagement corner 30 moves out of the notch 50 in the end of the window grill 46. Accordingly, the window grill clip 10 removably mounts the window grill 46 to the window 40.

While the presently preferred embodiments have been illustrated and described, numerous changes and modifications can be made without significantly departing from the spirit and scope of this invention. Therefore, the inventors intend that such changes and modifications are covered by the appended claims.

What is claimed is:

1. A window grill clip for attaching a window grill to a window, comprising:

a window frame segment;

a grill segment extending from the window frame segment, the grill segment defining an opening through the grill segment; and a tang having a first portion extending away from the grill segment on a side of the grill segment opposite the window frame segment and a second portion extending from the first portion and back toward the opening in the grill segment, the tang having a rounded grill engagement grill corner at a junction between the first and second portions of the tang.

2. The window grill clip of claim 1 wherein the second portion of the tang extends through the opening in the grill segment.

3. The window grill clip of claim 1 further comprising at least one spike extending from the frame segment.

4. The window grill clip of claim 1 wherein the grill segment has a tab extending downward from an end of the grill segment opposite an end of the grill segment connected to the frame segment.

5. The window grill clip of claim 1 wherein the grill segment is generally Y-shaped.

6. A window grill clip for attaching a window grill to a window, comprising:

a window frame segment;

a grill segment extending from the window frame segment, the grill segment defining an opening through the grill segment, the grill segment having a tab extending downward from an end of the grill segment opposite an end of the grill segment connected to the frame segment; and a tang having a first portion extending away from the grill segment on a side of the grill segment opposite the window frame segment and a second portion extending from the first portion and back toward the opening in the grill segment.

7. A grill clip for removably attaching a window grill to a window having a window frame holding a window pane, the grill clip comprising:

a window frame segment capable of being in contact with the window frame;

a grill segment extending from the window frame segment and defining an opening through the grill segment, the grill segment extending from the window frame segment toward the window grill when in use; and a tang engageable with the window grill and having a first portion extending away from the grill segment on a side of the grill segment opposite the window frame segment and a second portion extending from the first portion and back toward the opening in the grill segment, the tang having a rounded grill engagement corner at a junction between the first and second portions of the tang.

8. The wild grill clip of claim 7 wherein the second portion of the tang extends through the opening in the grill segment.

9. The window grill clip of claim 8 wherein the grill segment has a tab extending downward from an end of the grill segment opposite an end of the grill segment connected to the frame segment and capable of being in contact with the window grill.

10. The window grill clip of claim 9 wherein the grill segment is generally Y-shaped.

11. The window grill clip of claim 10 further comprising at least one spike extending from the frame segment and capable of being engaged with the window frame.

12. A grill clip for removably attaching a window grill to a window having a window frame holding a window pane, the grill clip comprising:

a window frame segment capable of being in contact with the window frame;

a grill segment extending from the window frame segment and defining an opening through the grill segment, the grill segment extending from the window frame segment toward the window grill when in use, the grill segment having a tab extending downward from an end of the grill segment opposite an end of the grill segment connected to the window frame segment and capable of being in contact with the window grill; and a tang engageable with the window grill and having a first portion extending away from the grill segment on a side of the grill segment opposite the window frame segment and a second portion extending from the first portion and back toward the opening in the grill segment.

13. A method of making a window grill clip useable to attach a window grill to a window, comprising the steps of:

forming a window frame segment;

forming a grill segment extending from the window frame segment;

defining an opening through the grill segment;

forming a tang having a first portion extending away from the grill segment on a side of the grill segment opposite the window frame segment and a second portion extending from the first portion and back toward the opening in the grill segment; and forming a rounded grill engagement corner at a junction between the first and second portions of the tang.

14. The method of making a window grill clip of claim 13 wherein the steps of defining an opening through the grill segment and forming a tang further comprise the step of forming a portion of the grill segment into the tang and to define the opening through the grill segment.

15. The method of making a window grill clip of claim 14 further comprising the step of forming a grill tab extending downward from an end of the grill segment opposite an end of the grill segment connected to the frame segment.

16. A method of making a window grill clip useable to attach a window grill to a window, comprising the steps of:

forming a window frame segment;

forming a grill segment extending from the window frame segment;

forming a grill tab extending downward from an end of the grill segment opposite an end of the grill segment connected to the window frame segment;

defining an opening through the grill segment; and forming a tang having a first portion extending away from the grill segment on a side of the grill segment opposite the window frame segment and a second portion extending from the first portion and back toward the opening in the grill segment.

17. A grill clip and a window grill removably attached to a window frame by the grill clip, comprising:

a window frame segment in contact with the window frame;

a grill segment extending from the window frame segment toward the window grill, the grill segment defining an opening through the grill segment; and a tang engaged with the window grill and having a first portion extending away from the grill segment and a second portion extending from the first portion and back toward the opening in the grill segment.

* * * * *